US005926875A

United States Patent [19]

Okamoto et al.

[11] Patent Number: 5,926,875

[45] Date of Patent: Jul. 27, 1999

[54] NURSED PERSON'S BED WITH FLUSH TOILET

[75] Inventors: Kiyoshi Okamoto; Hironobu Nakayama, both of Tokyo, Japan

[73] Assignee: Tama Juki Construction Co., Ltd., Machida, Japan

[21] Appl. No.: 08/893,501

[22] Filed: Jul. 11, 1997

[51] Int. Cl.[6] ..... A61G 9/00

[52] U.S. Cl. ..... 5/605; 5/604; 5/606; 5/695

[58] Field of Search ..... 5/605, 604, 606, 5/695; 4/244.2, 244.1

[56] References Cited

U.S. PATENT DOCUMENTS

| | | | |
|---|---|---|---|
| 2,564,135 | 8/1951 | Touchberry | 5/605 |
| 3,943,583 | 3/1976 | Ishikawa | 5/605 |
| 4,631,762 | 12/1986 | Fugett | 5/605 |
| 4,677,700 | 7/1987 | Su | 5/604 |
| 5,060,325 | 10/1991 | Carnahan et al. | 5/605 |
| 5,077,845 | 1/1992 | Tokunaga et al. | 5/605 |
| 5,350,369 | 9/1994 | Workman et al. | 5/604 |
| 5,461,738 | 10/1995 | Kimura et al. | 5/605 |

*Primary Examiner*—Michael F. Trettel
*Assistant Examiner*—Fredrick Conley
*Attorney, Agent, or Firm*—Wenderoth, Lind & Ponack, L.L.P.

[57] ABSTRACT

A bed, in combination with a flush toilet, has a bed body (1) provided with an opening (2). The opening has a width which is sufficient to accommodate the hips of a sick or disabled person laying on the bed. The opening (2) can be opened and closed by a cover (4). The cover can be withdrawn from a retracted (open) position where it is accommodated on the back of the bed body (3) to close the opening (2). A flush toilet (8) is disposed below the opening (2). A toilet seat (8) is disposed in the opening and has a somewhat cylindrical excreta guide (9) for reliably guiding excreta into the flush toilet (8). The toilet seat (7) can be tilted about a vertical axis by a lift (10). Also, the toilet seat free end is tilted upward so as to be in close contact with the hips of the sick or disabled person.

8 Claims, 5 Drawing Sheets

NURSED PERSON'S BED WITH FLUSH TOILET

BACKGROUND OF THE INVENTION

1. Field of the Invention

This invention relates to nursed person's beds for crippled or sick persons and, more particularly, a nursed person's bed with a flush toilet, which can be used by a crippled or sick person who cannot easily go to a toilet from a bed without leaving the bed.

2. Prior Art

A crippled or sick person who cannot easily go to a toilet, uses a portable simplified toilet whenever he or she defecates or relieves himself or herself on the bed.

However, when the crippled or sick person defecates or relieves himself or herself while lying on his or her back on the bed by using the simplified toilet, he or she cannot apply sufficient forces to the pertinent parts of the body to smoothly defecate or relieve himself or herself. Besides, great amounts of excreta may be attached to the pertinent parts of the body. Therefore, the simplified toilet cannot be easily used by the crippled or sick person.

Moreover, it requires skill and considerable labor to set the simplified toilet under the user's hips or removing it therefrom after the defecation or relieving. Furthermore, after the defecation or relieving using the simplified toilet, it is necessary to dispose of the excreta, wash the simplified toilet as well as the lower half of the nursed person's body and remove odor in the room by means of ventilation. It will take a great deal of time for a nurse to perform these tasks.

SUMMARY OF THE INVENTION

The invention is predicated on a basic concept that a toilet is assembled in a nursed person's bed to be used by a crippled or sick person.

A first object of the invention is to provide a nursed person's bed with a flush toilet, which permits a crippled or sick person to defecate or relieve himself or herself smoothly by applying sufficient forces to the pertinent parts of the body in a posture close to the one in which the usual defecation or relieving is performed even while lying on the bed. The bed makes it possible to avoid attachment of great amounts of excreta to the pertinent parts of the body, and requires only water washing of the toilet after the defecation or relieving, making it unnecessary for the nurse to dispose of the excreta, wash the toilet as well as the lower half of the nursed person's body or remove odor from the room by ventilation or the like.

A second object of the invention is to permit hot water, as used to wash the lower half of the body of the person lying on the bed after the defecation or relieving, to be led smoothly into the flush toilet without the possibility of running-over.

A third object of the invention is to provide a nursed person's bed with a flush toilet, which can be immediately restored after the defecation or relieving to a state in which one can lye on it quite sanitarily.

DETAILED DESCRIPTION OF THE PREFERRED EMBODIMENTS

Figure 1:
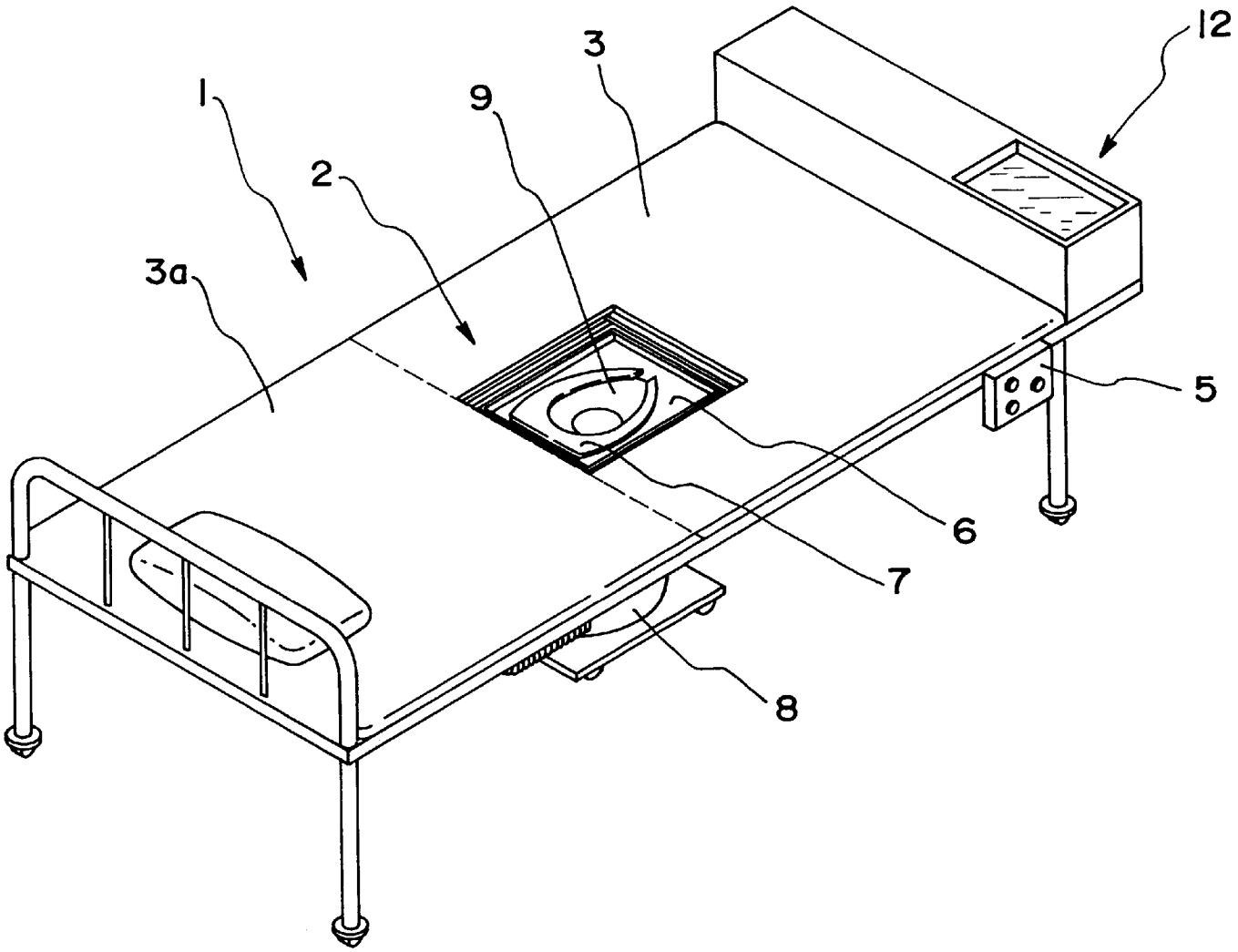
FIG. 1 is a perspective view showing a nursed person's bed with a flush toilet according to the invention.

FIG. 1 shows a nursed person's bed with a flush toilet embodying the invention. Reference numeral 1 designates the nursed person's bed with a flush toilet. The bed 1 has a bed body 3, on which a mattress, bedclothes, etc. can be laid down. The bed body 3 has a rectangular opening 2 formed at an intermediate position. The opening 2 has a width such that the hips of a person lying on the bed 1 can be inserted through it. The opening 2 can be opened and closed by a cover 4, which is in the form of a shutter guided along grooves or rails provided on opposite sides of the opening 2.

Figure 2:
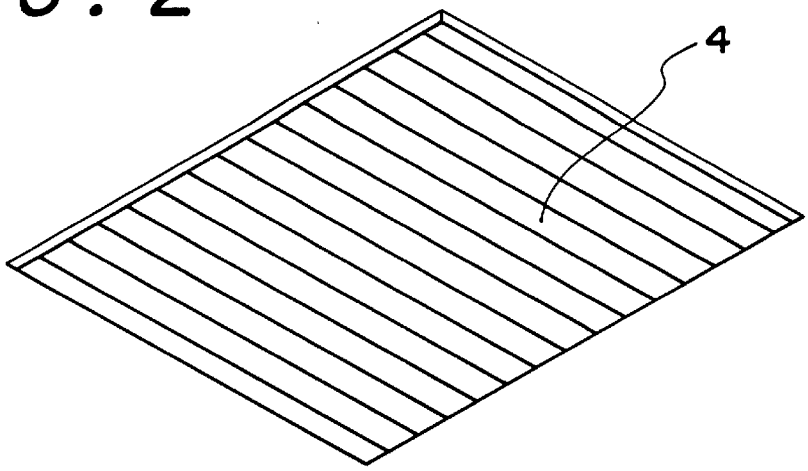
FIG. 2 is a view illustrating operation of a cover in the nursed person's bed for the flush toilet according to the invention.
Figure 3:
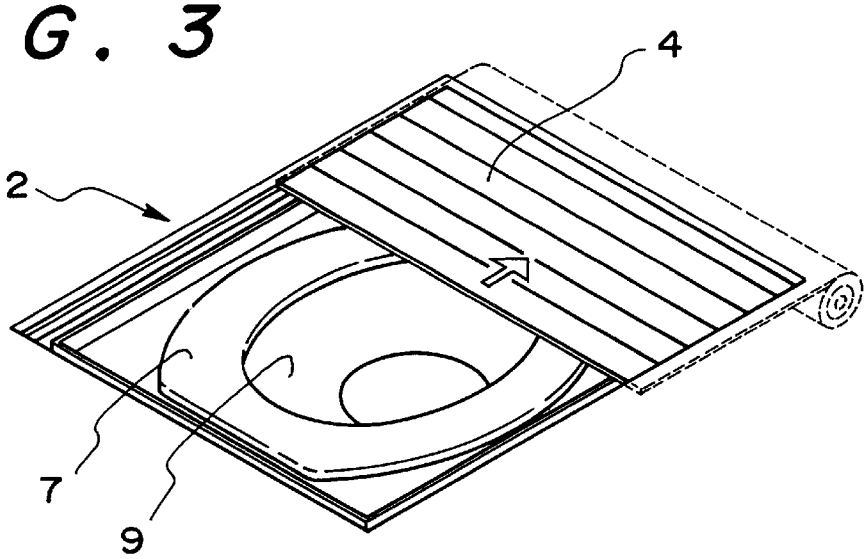
FIG. 3 is another view illustrating the operation of the cover in the nursed person's bed for the flush toilet according to the invention.
Figure 4:
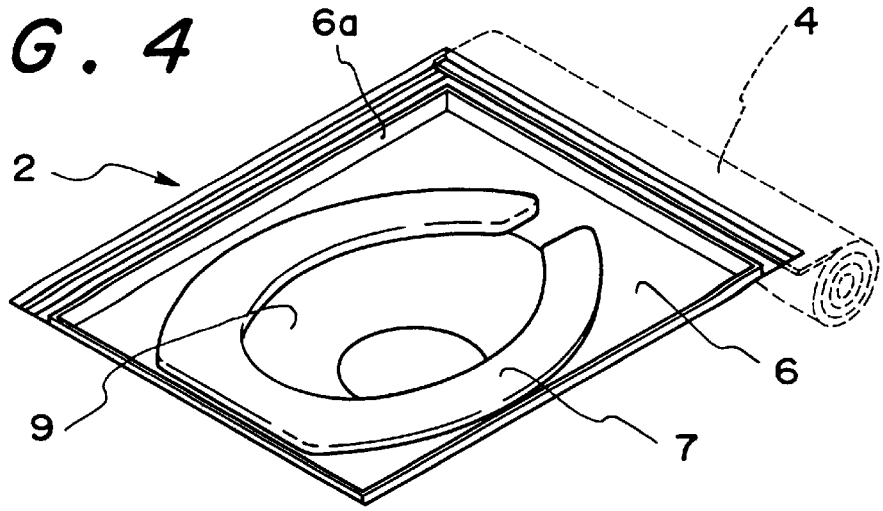
FIG. 4 is a further view illustrating the operation of the cover in the nursed person's bed for the flush toilet according to the invention.

As shown in FIGS. 2 to 4, the cover 4 can be opened and closed by operating an operating panel 5, which is provided on one side of the bed 1. As it is opened, the cover 2 is compactly wound into a roll and accommodated on the back of the bed body 3.

In the opening 2, a toilet seat 7 is disposed, which has a collector 6 with upright edge walls 6*a*. A flush toilet is disposed underneath the toilet seat 7. The flush toilet 8 is installed on a base with casters for rolling over the floor. The toilet seat 7 has a roughly cylindrical excreta guide 9 depending from the outer periphery of the seat. The width of the guide 9 is reduced downwardly to reliably guide excreta into the flush toilet 8 without the possibility of spattering.

Figure 5:
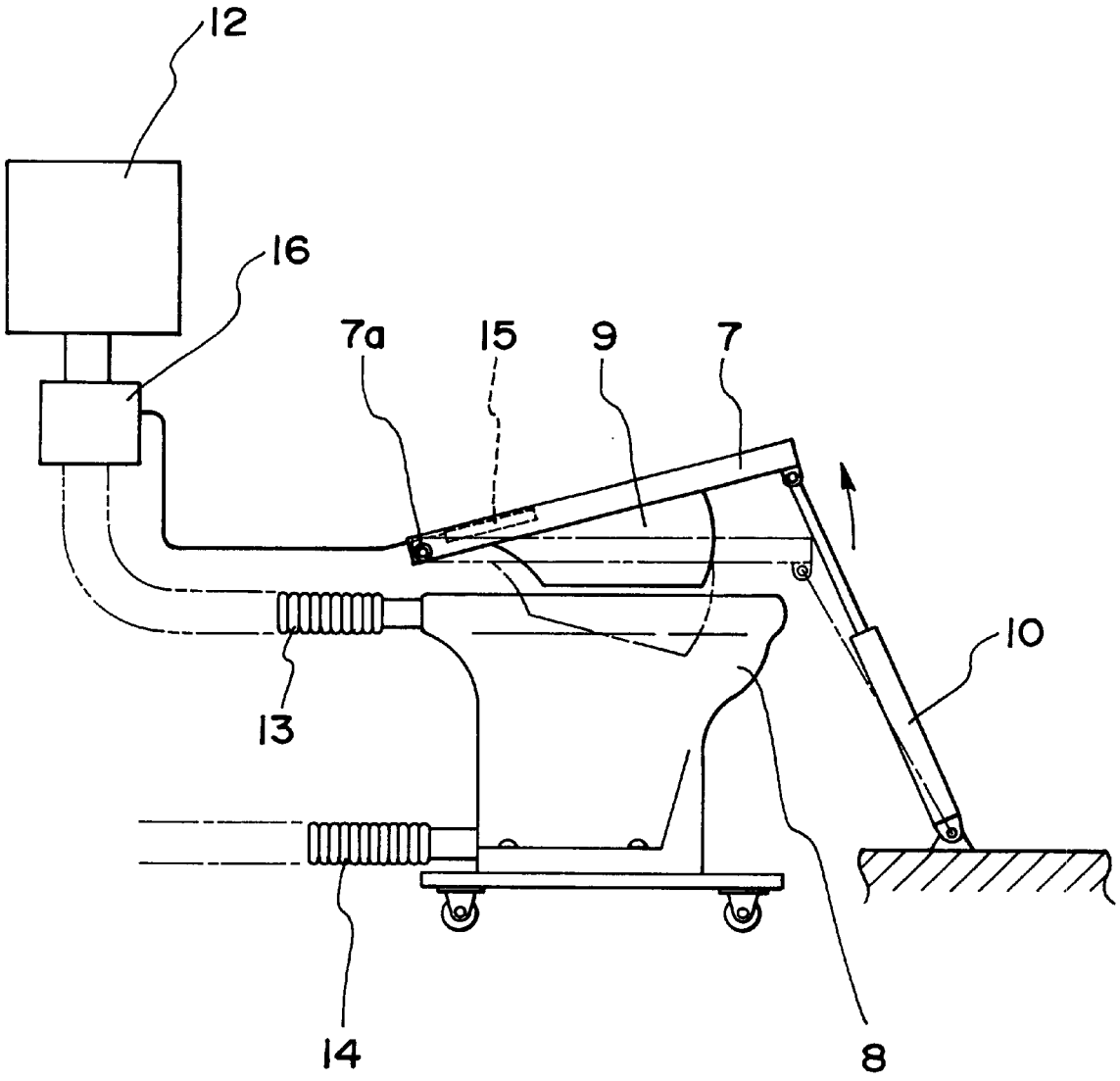
FIG. 5 is a view illustrating a tilting operation of a toilet seat in the nursed person's bed for the flush toilet according to the invention.

As shown in FIG. 5, the toilet seat 7 can be tilted upwardly about a fulcrum 7*a* provided nearer the nursed person's head by an automatic lifter 10, which may be an air cylinder, an oil hydraulic cylinder, etc. The toilet seat 7 is operable by operating the operating panel 5, or by manually operating a crank tool or the like such that its free end is brought to a higher level than the plane of the bed body 3. A stopper or a limit switch (not shown) may be provided in the neighborhood of the toilet seat 7 and lift member 10 in order to hold the lift member 10 secured to the back surface of the bed body 3 or set upper and lower limits of tilting of the toilet seat 7.

Figure 6:
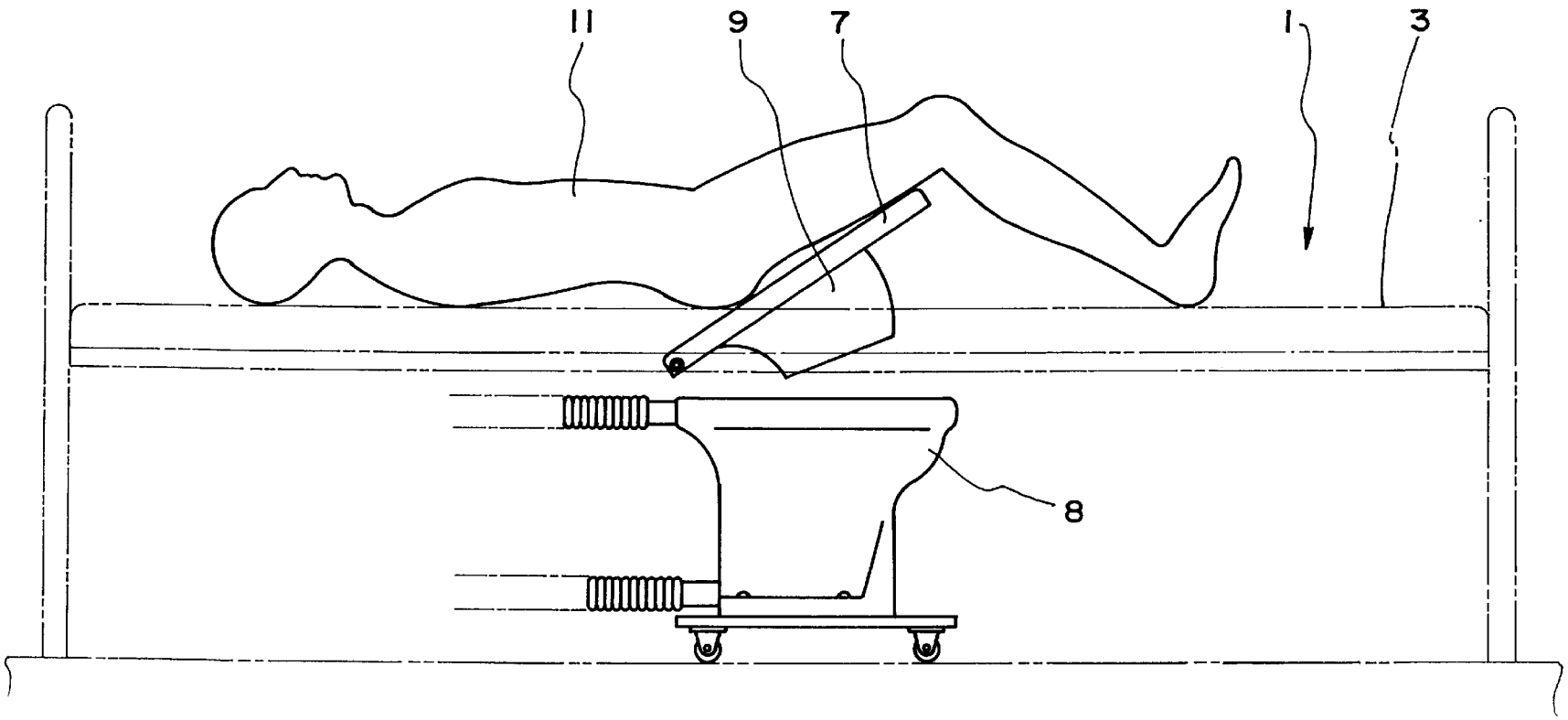
FIG. 6 is a view illustrating the manner of using the nursed person's bed with a flush toilet according to the invention.
Figure 7:
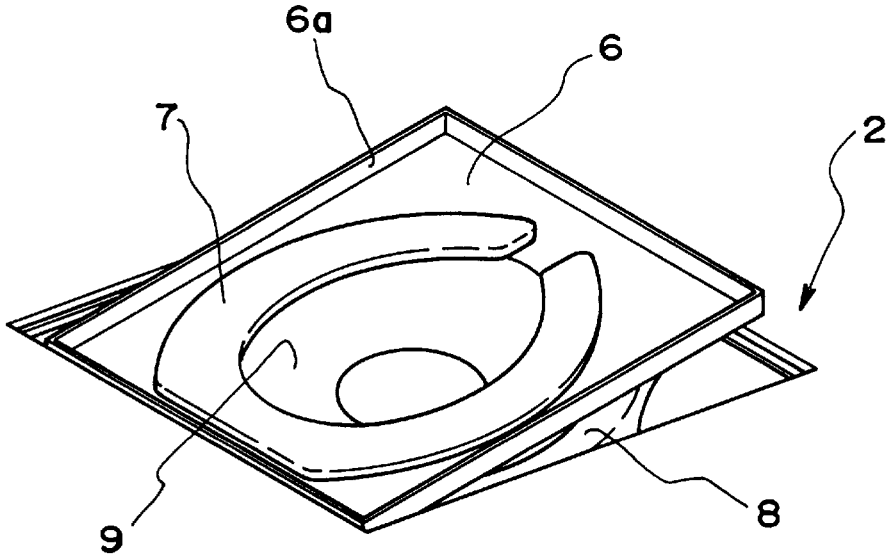
FIG. 7 is a fragmentary perspective view showing the manner of tilting the toilet seat in the nursed person's bed with a flush toilet according to the invention.

Usually, when the nursed person defecates or relieves himself or herself while lying on his or her back on the bed, he or she assumes a posture different from the posture when seated on an ordinary toilet seat. In this posture, he or she cannot apply sufficient forces to the pertinent parts of the body. In addition, since the pertinent parts of the body are not sufficiently exposed, great amounts of excreta are liable to be attached to these parts of the body. In contrast, the toilet seat 7 according to the invention, as shown in FIG. 6, can be moved into an upwardly tilted state and into contact with the hips of the nursed person 11. In this state, the nursed person 11 can assume a posture, which is close to the posture of the ordinary defecating or relieving position. This posture is suitable for the nursed person 11 to defecate or relieve himself or herself by allowing stable forces to be applied to the pertinent parts of the body. Besides, the pertinent parts of the body can be sufficiently exposed to prevent attachment of the excreta to the pertinent parts of the body as much as possible.

Reference numeral 12 designates a water tank which is disposed at the rear end of the bed 1 and at a higher level than the level of the bed body 3. Water for washing can be supplied from the water tank 12 into the flush toilet 8 via a bellows-like flexible water supply tube 13. Reference numeral 14 is a bellows-like flexible draining tube, which is connected to a draining port of the flush toilet 8 for draining material therefrom.

Since the water supply and draining tubes 13 and 14 are flexible and not twisted or bent by slightly moving the flush toilet 8, the flush toilet 8 can be pulled out together with the base with the casters in the inclined state of the toilet seat 7 side-wise from its position in the bed 1. It is thus possible to manually clean the flush toilet 8 carefully.

Reference numeral 15 designates a sensor, i.e., pressure sensor means, which is disposed on the toilet seat 7. When the hips lying on the bed are brought into contact with it, the sensor 15 detects the weight (or pressure) of the hips and generates a signal. Reference numeral 16 designates a water supply controller, which is provided on the water supply tube 13 or the joint between the water tank 12 and the water supply tube 13, and opens a valve according to a signal from the sensor 15, thus allowing water in the water tank 12 to be supplied to the flush toilet 8.

The water supply controller 16 is operated in an interlocked relation to the sensor 15 as follows. If the water supply controller 16 is adapted to cause water to be supplied immediately in response to a signal, which is generated by the sensor 15 when the hips of the person lying on the bed are brought into contact with the toilet seat 7, the timing of supplying water to the flush toilet 8 is too early. A suitable timing for the delivery of water is when the water supply controller 16 receives a signal, which is generated by the sensor 15 when the hips, which have been in contact with the toilet seat 7 are separated from the toilet seat 7. Instead of using the sensor 15 and the water supply controller 16, it is possible to cause water to be supplied by manually operating a conventional water tank lever or the like.

The sensor 15 may be a temperature sensor means for detecting the temperature of the man's body or the like, an odor sensor means for detecting the odor of the excreta, etc. as well as the above pressure sensor means, and it may be provided in the flush toilet as well as in the toilet seat.

The nursed person's bed with a flush toilet having the construction as described above according to the invention is used as follows. The person lying on his or her back on the bed 1 is shifted to the left or right aside from the opening 2, and then the cover 4 is opened by operating the operating panel 5. Then, the person is brought to a lying state such that his or her hips are located above the toilet seat 7. In the case where the nursed person's bed can be tilted, a front, or head side, portion 3*a* of the bed body 3 is tilted to tilt up the upper half of the body to a somewhat upright state. Even where the bed 1 is incapable of tilting a head side portion of the bed body 1, the toilet seat 7 can be tilted such that the hips of the nursed person 11 are moved into a posture just like that of the ordinary defecation or relieving posture. The nursed person 11 thus can defecate or relieve in a posture permitting stable application of sufficient forces to this end.

Where the toilet seat is provided with a hot water washer, subsequent to the defecation or relieving, the hips are washed with hot water. Where no hot water washer is provided, the nurse can wash the lower half of the body of the nursed person in the same posture as before with hot water or the like at hand. As it is used, the water is collected without running-over by the collector 6 with the upright edge walls so as to be led through the roughly cylindrical excreta guide 9 into the flush toilet 8. Subsequently, the flush toilet 8 is washed with water supplied form the water tank 12 either by the above sensor operation or manually.

Figure 8:
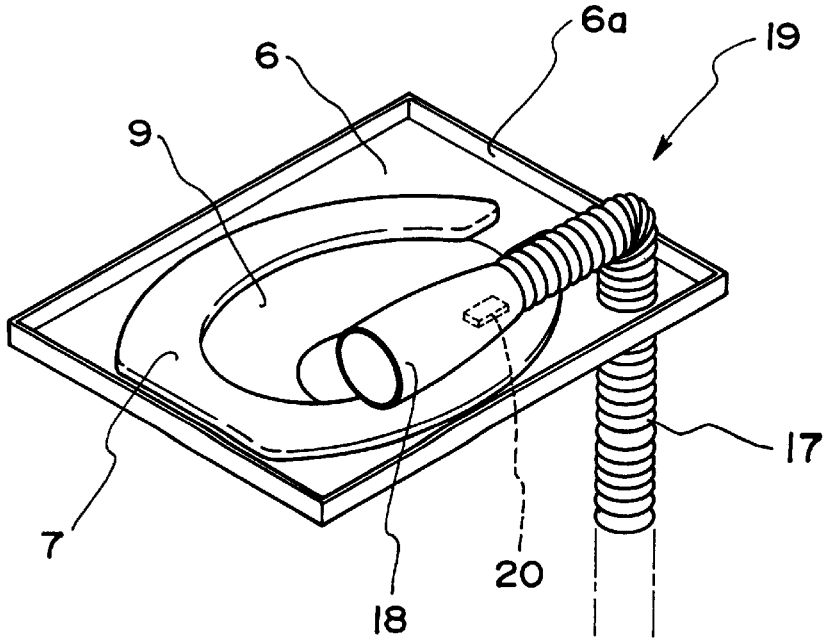
FIG. 8 is a fragmentary perspective view showing a second embodiment of the nursed person's bed with a flush toilet according to the invention.

FIG. 8 shows a different embodiment of the nursed person's bed with a flush toilet according to the invention. In this embodiment, the collector 6 of the toilet seat 7 is provided with a urine extractor 19. The urine extractor 19 is in the form of a tube 17, which has a lower end which extends into the flush toilet and funnel-shaped contact member 18 provided at the other end. Using this urine extractor 19, the nursed person lying on his or her back on the nursed person's bed with a flush toilet according to the invention can reliably relieve himself or herself without possibility of running-over of urine. As the urine extractor 19, two different types, one for the man and the other for the woman, may be provided and adapted to be detachably mounted.

It is further possible to provide a urine sensor 20 for detecting urine in the urine extractor 19. The urine sensor 20 may be an electric conduction sensor means, which generates a signal when its electrodes are brought into conduction with each other by conductive urine, or an ammonia sensor means, which detects ammonia in urine. The urine sensor 20 may be connected to the water supply controller 16 to cause automatic water supply to the flush toilet 8 upon detection of urine by it.

As the urine sensor may be used a pressure sensor means, a temperature sensor means, an odor sensor means, an electric conduction sensor means, an ammonia sensor means or any other sensor means so long as it is capable of detecting the defecation or relieving.

As has been described in the foregoing, according to the invention a sick or disabled person who is laying on and incapable of leaving the bed, does not need to use a conventional simplified toilet, which is difficult to set under the hips for the defecation or relieving and to subsequently remove from under the hips, and with which it is difficult to make smooth defecation or relieving. Instead, the sick or disabled person lying on his or her back on the bed, can have his or her hips in close contact with the toilet seat, which is tilted upward toward its free end. This posture of the sick or disabled person is close to the ordinary defecation or relieving posture, and is thus suitable for the defecation or relieving. Thus, he or she can apply sufficient forces to this end. In addition, since the pertinent parts of the body are sufficiently exposed, it is possible to prevent attachment of excreta to these parts of the body as much as possible. Furthermore, the flush toilet can be water washed after use. It is thus unnecessary for the nurse to take time for tasks such as the disposal of excreta, washing of the flush toilet as well as the lower half of the nursed person's body, removal of odor from the room by ventilation, etc.

Where a cover is provided, which can be accommodated on the back side of the bed body during defecation or relieving and cover the opening of the bed afterwards, the nursed person's bed may be used as an ordinary bed when defecation or relieving is not necessary, while permitting the toilet to be readily set up in the bed for the excretion or relieving.

Where the flush toilet is provided with flexible water supply and draining tubes, which are not twisted or bent by slightly moving the flush toilet, it is possible to remove the flush toilet from its use position in the bed for careful cleaning.

Where the toilet seat is provided with the collector with the upright edge walls, hot water can be used to wash the lower half of the person lying on the bed after the defecation or relieving, and can be collected and led into the flush toilet for disposal.

Where the toilet seat is provided with the urine extractor in the form of a flexible tube, which has a lower end extending into the flush toilet and a funnel-like contact member provided at the other end, one who is lying on his or her back on the bed can reliably relieve himself or herself without the possibility of running-over of urine.

Where the sensor for detecting the defecation or relieving is provided on the flush toilet or toilet seat and the water supply controller is provided between the sensor and the water tank to cause the water supply to the flush toilet in response to the detection of defecation or relieving by the sensor, the nurse's care-taking can be further reduced, and the nursed person's bed with a flush toilet can be used more conveniently.

Where the urine extractor is provided with a urine sensor such as an electric conduction sensor means or an ammonia sensor means for detecting urine, water can be automatically supplied to the flush toilet in response to the detection of relieving by the urine sensor, which is convenient for the user while also alleviating the nurse's care-taking.

What is claimed is:

1. A bed for a sick or disabled person, said bed comprising:

a bed body for supporting the sick or disabled person, said bed body having an opening extending through an intermediate portion of said bed body;

a flush toilet disposed below said opening;

a toilet seat disposed in said opening and pivotally connected to said bed body so as to be adjacent to the hips of the sick or disabled person during use;

a collecting structure connected to said toilet seat and extending outwardly therefrom, said collecting structure having an outer periphery defined by upwardly projecting peripheral walls;

a guide depending from an outer periphery of said toilet seat for guiding excreted matter into said flush toilet; and a cover for selectively opening and closing said bed body opening, wherein said cover is slidably disposed over said bed body opening, and said cover is retractable from a closed position covering said bed body opening to an open position at which said cover is wound in a roll below an upper lever of said bed body.

2. The bed as claimed in claim 1, further comprising:

a flexible water supply tube for supplying water to said flush toilet; and a flexible drain tube for conducting drainage from said flush toilet.

3. The bed as claimed in claim 2, further comprising a water supply tank connected to an end of said flexible water supply tube, wherein said water supply tank is disposed at a level which is higher than that of said flush toilet.

4. The bed as claimed in claim 1, further comprising a urine extractor which includes:

a tube extending through said collector, said tube having a first end and a second end which extends into said flush toilet; and a funnel-like member connected to said first end of said tube, said funnel-like member being located in the vicinity of said toilet seat.

5. The bed as claimed in claim 4, wherein said urine extractor includes an electric conduction sensor means or an ammonia sensor means for detecting the presence of urine.

6. The bed as claimed in claim 1, further comprising:

a water tank in communication with said flush toilet;

a sensor provided on one of said flush toilet and said toilet seat for detecting defecation or urination by the sick or disabled person; and a water supply controller, disposed between said sensor and said water tank, for causing water to be supplied from said water tank to said flush toilet in response to a detection signal emitted from said sensor.

7. The bed as claimed in claim 6, wherein said sensor is provided on said toilet seat.

8. The bed as claimed in claim 1, further comprising a lifting mechanism connected to a free end of said toilet seat for pivoting said toilet seat upwardly into contact with the hips of the sick or disabled person.

* * * * *